US006678973B2

(12) United States Patent
de Mori

(10) Patent No.: US 6,678,973 B2
(45) Date of Patent: Jan. 20, 2004

(54) VAPOR DISTRIBUTION DEVICE, PARTICULARLY FOR ELECTRICAL HOUSEHOLD APPLIANCES

(76) Inventor: Ezio de Mori, Via Livel, 1/B, 31012 Cappela Maggiore (IT)

( * ) Notice: Subject to any disclaimer, the term of this patent is extended or adjusted under 35 U.S.C. 154(b) by 231 days.

(21) Appl. No.: 10/003,435

(22) Filed: Dec. 6, 2001

(65) Prior Publication Data

US 2002/0069563 A1 Jun. 13, 2002

(30) Foreign Application Priority Data

Dec. 12, 2000 (IT) ..... TV2000A0155

(51) Int. Cl.[7] ..... D06F 75/02; D06F 75/12
(52) U.S. Cl. ..... 38/77.6
(58) Field of Search ..... 38/4, 77.6, 77.9, 38/85, 104, 77.3, 82; 68/222; 210/263, 264, 282; 261/18.1, 19, 20, 21, 38, 42

(56) References Cited

U.S. PATENT DOCUMENTS 2,861,364 A * 11/1958 Klein ..... 38/77.6
4,875,301 A * 10/1989 Adams ..... 38/14
5,307,440 A 4/1994 Carretto
5,428,910 A * 7/1995 Gudefin et al. ..... 38/77.6
5,526,595 A * 6/1996 Daulasim et al. ..... 38/77.8
5,743,034 A * 4/1998 Debourg et al. ..... 38/77.8
6,061,935 A * 5/2000 Lee ..... 38/77.6

FOREIGN PATENT DOCUMENTS

| | | |
|---|---|---|
| DE | 200 01 650 | 3/2000 |
| EP | 0 595 292 | 5/1994 |
| EP | 0 645 488 | 3/1995 |
| FR | 2 582 028 | 11/1986 |
| FR | 2 603 976 | 3/1988 |

* cited by examiner

*Primary Examiner*—Ismael Izaguirre
(74) *Attorney, Agent, or Firm*—Guido Modiano; Albert Josif; Daniel O'Byrne

(57) ABSTRACT

A vapor distribution device, usable particularly with electrical household appliances which comprise a boiler for producing water vapor or steam, which is connected through a first duct to at least one first element for distributing the steam. The distribution device comprises at least one separate second duct for feeding the steam to at least one second distribution element, with the interposition of suitable flow control elements for one or more containers of separate additives.

30 Claims, 7 Drawing Sheets

1
2a
3
7
8
9
10
11
12
13
14
15

VAPOR DISTRIBUTION DEVICE, PARTICULARLY FOR ELECTRICAL HOUSEHOLD APPLIANCES

BACKGROUND OF THE INVENTION

The present invention relates to a vapor distribution device, particularly suitable to be used with electrical household appliances, such as for example irons, sterilization machines and machines for washing floors by means of water vapor or steam.

Electrical household appliances of a known type are currently in use comprising a boiler that contains water to be heated to its boiling point, so as to obtain a flow of pressurized steam.

Usually, the water is made to boil by means of one or more coils heated electrically by Joule effect and arranged inside a boiler.

The steam obtained in the boiler is conveyed, by means of an electric valve, into suitable ducts and then sent, usually upon a request of the user, to the application device, which can consist of an iron, a brush or, depending on the instances, another device suitable to use steam in the most appropriate manner.

In many of these applications it is necessary or convenient to use additives: in the case of an iron, for example, pressing an item of clothing is improved and more pleasant if fabric sizing, a fragrance or a stain remover is used.

Products for using these additives are currently known which consist of a container for separate application, which is achieved by spraying or impregnating part or all of the item of clothing by using therefore spray cans or other devices capable of atomizing or vaporizing such additives.

The main drawback of such known types of application system consists in that they require application separately from the emission of steam, and this entails above all a great expenditure of time in alternating the ironing of the item with the application of the various additives; moreover, there is a considerable space occupation proximate to the ironing board, since it is necessary to have available various spray cans, all of which are rather bulky.

Another disadvantage, which is directly linked to the preceding one, consists in that application of these substances separately from the steam is not equally effective, since the additives are sprayed onto the item of clothing, depositing by gravity onto its outer surface without penetrating deeply into the fabric.

Another drawback of known types is that the use of spray cans, despite the fact that they are now filled with propellant gases that are less harmful than in the past, is still harmful for the environment and also requires disposal of the can once its contents have been used up.

Another system for using these additives is also known which substantially consists in introducing them, usually in liquid form, into the water tank of the boiler.

In particular, for example, before the heating step it is possible to dissolve into the water drops of a fragrance or of a starching or detergent substance, depending on the electrical household appliance being used and on the purposes of the user.

This known type of system, however, has the severe drawback that over time it is very harmful to the boiler.

Part of the introduced additives, often created to be atomized but not vaporized in a boiler, in fact remains inside the boiler and deposits on the walls and on the coil: the worst problems are produced on such coil, degrading its operation and efficiency until the small electrical household appliance fails or permanently breaks down.

SUMMARY OF THE INVENTION

The aim of the present invention is therefore to solve the noted technical problems, eliminating the drawbacks of the cited known art by providing a vapor distribution device, particularly suitable to be used with small electrical household appliances, which allows to achieve a conveyance of additives, such as for example detergents, fragrances or starching agents, which is quick and simple to perform and at the same time avoids any damage to the correct operation of said small electrical household appliance. Within this aim, an object of the invention is to provide a device that allows to achieve the intended aim while providing maximum respect for the environment, both by reducing considerably the quantity of waste products to be disposed of and by eliminating the release of noxious gases into the atmosphere.

Another important object is to provide a device that allows easy and low-cost use of additives, since neither propellants nor pressurized cans are necessary.

Another object is to provide a device that is structurally simple and has low manufacturing costs.

This aim and these and other objects that will become better apparent hereinafter are achieved by a vapor distribution device, particularly for electrical household appliances provided with a boiler for producing water vapor or steam, which is connected through a first duct to at least one first means for distributing said steam, characterized in that it comprises at least one separate second duct for feeding the steam to at least one second distribution means, with the interposition of flow control means for one or more containers of separate additives.

BRIEF DESCRIPTION OF THE DRAWINGS

Further characteristics and advantages of the invention will become better apparent from the detailed description of a particular embodiment, illustrated only by way of non-limitative example in the accompanying drawings, wherein.

DESCRIPTION OF THE PREFERRED EMBODIMENTS

Figure 4:
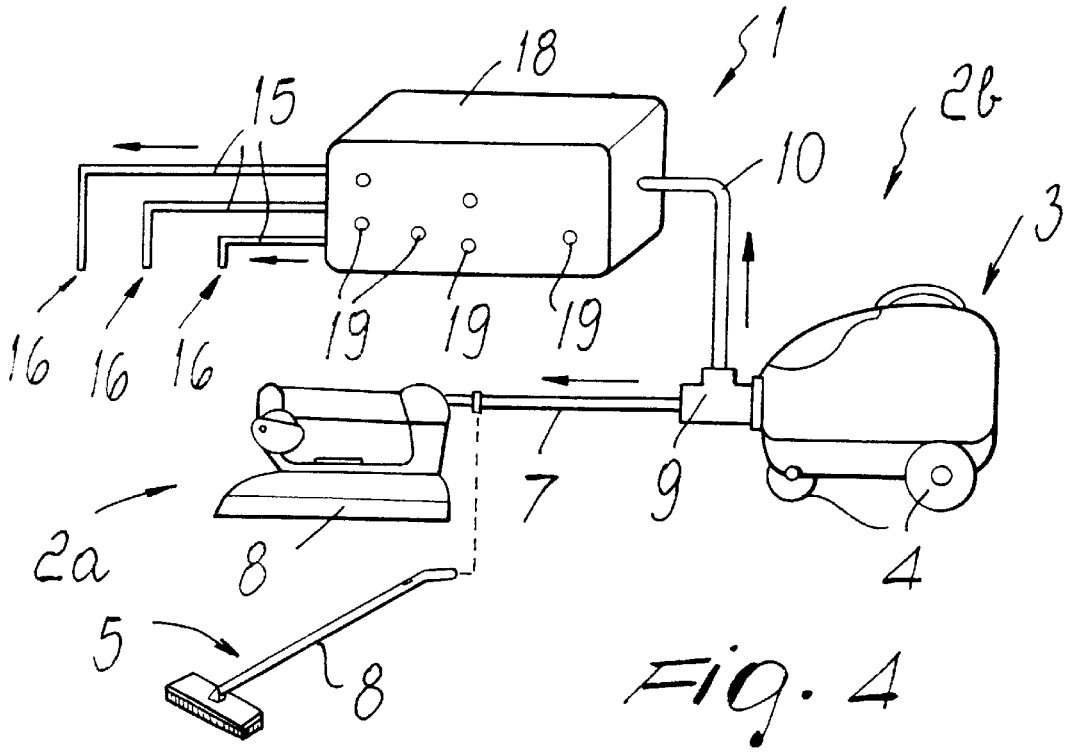
Figure 5:
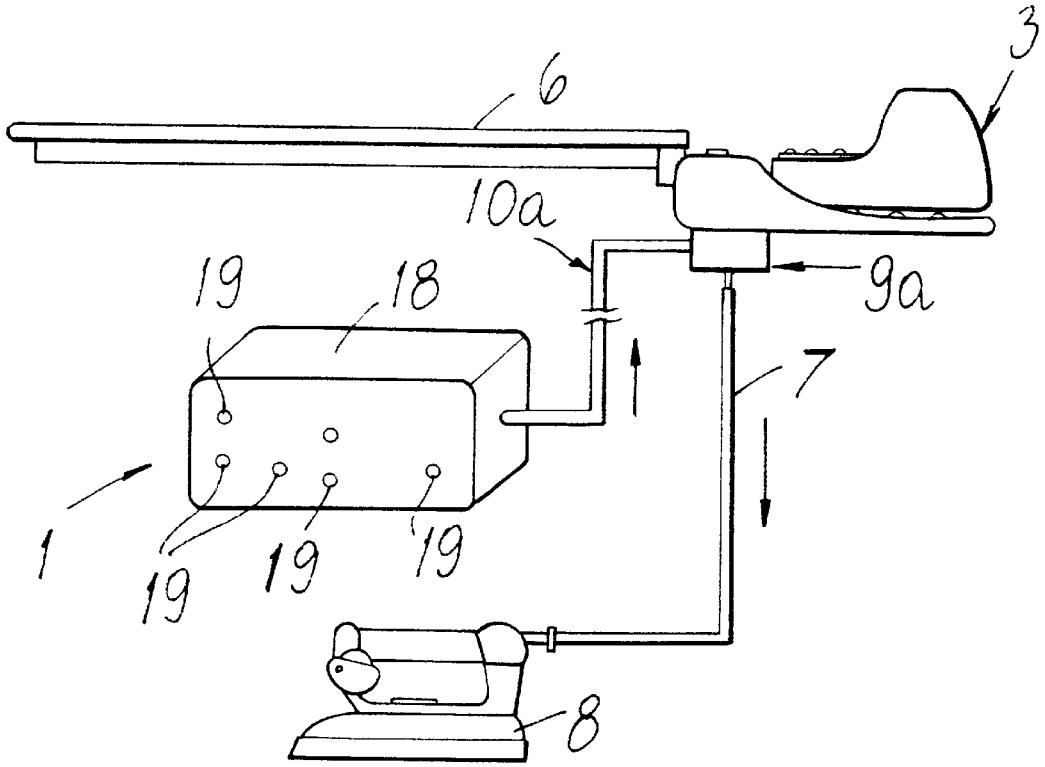
Figure 6:
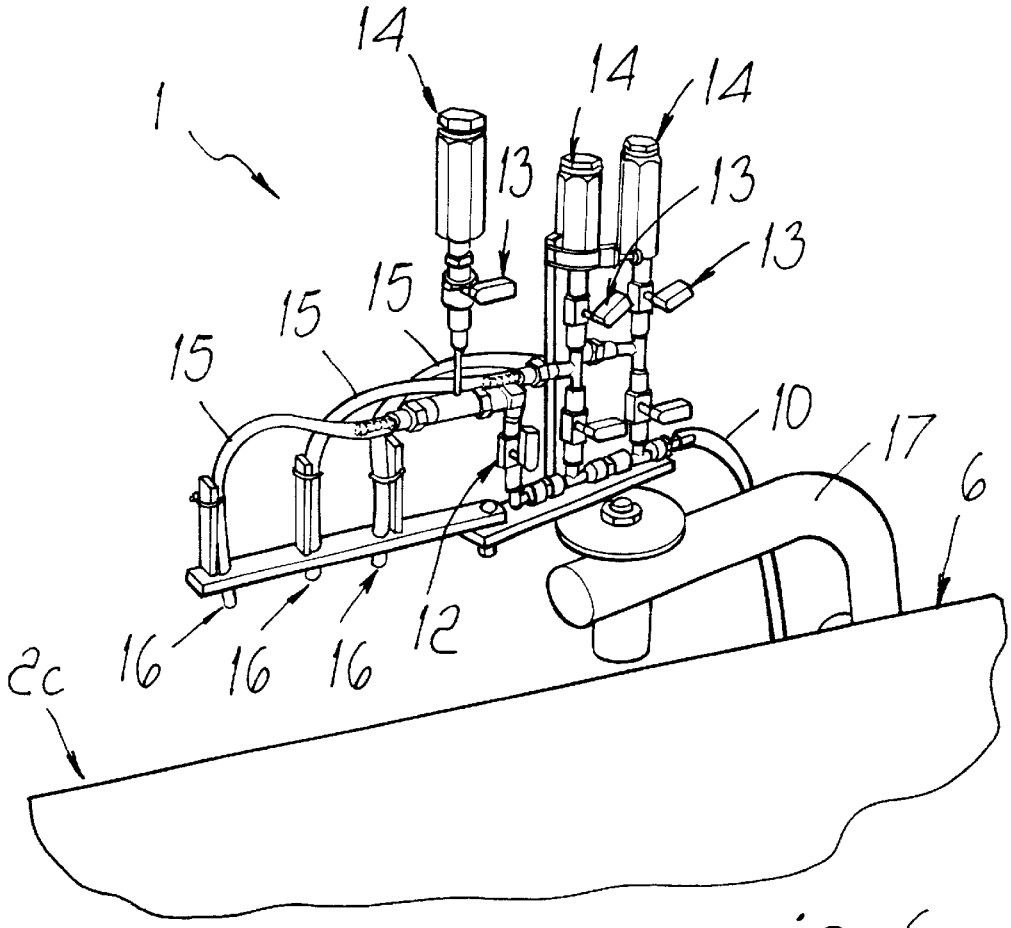
FIGS. 6 and 7 are perspective views of an embodiment of the invention applied to an ironing board combined with a steam boiler.
Figure 7:
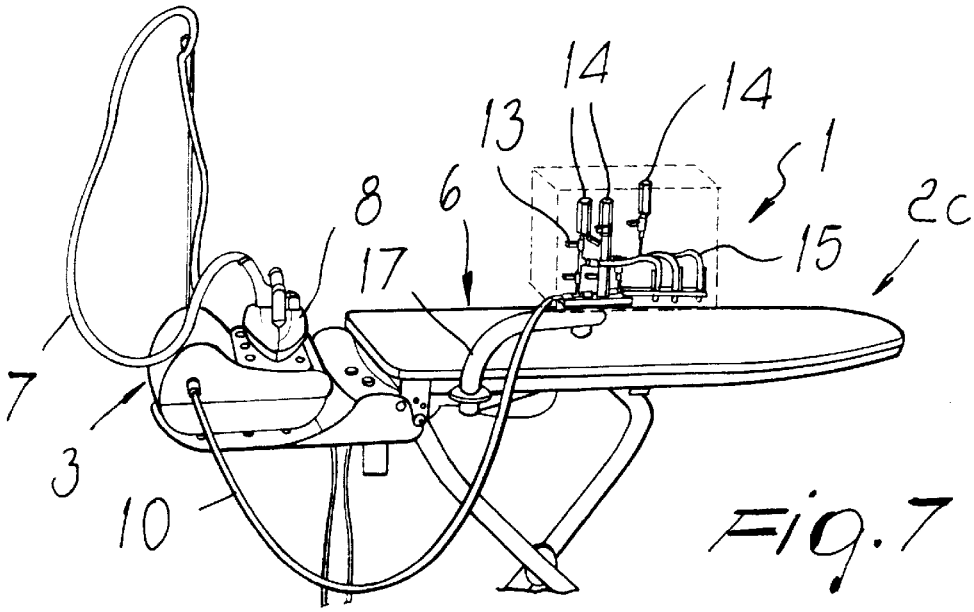
Figure 8:
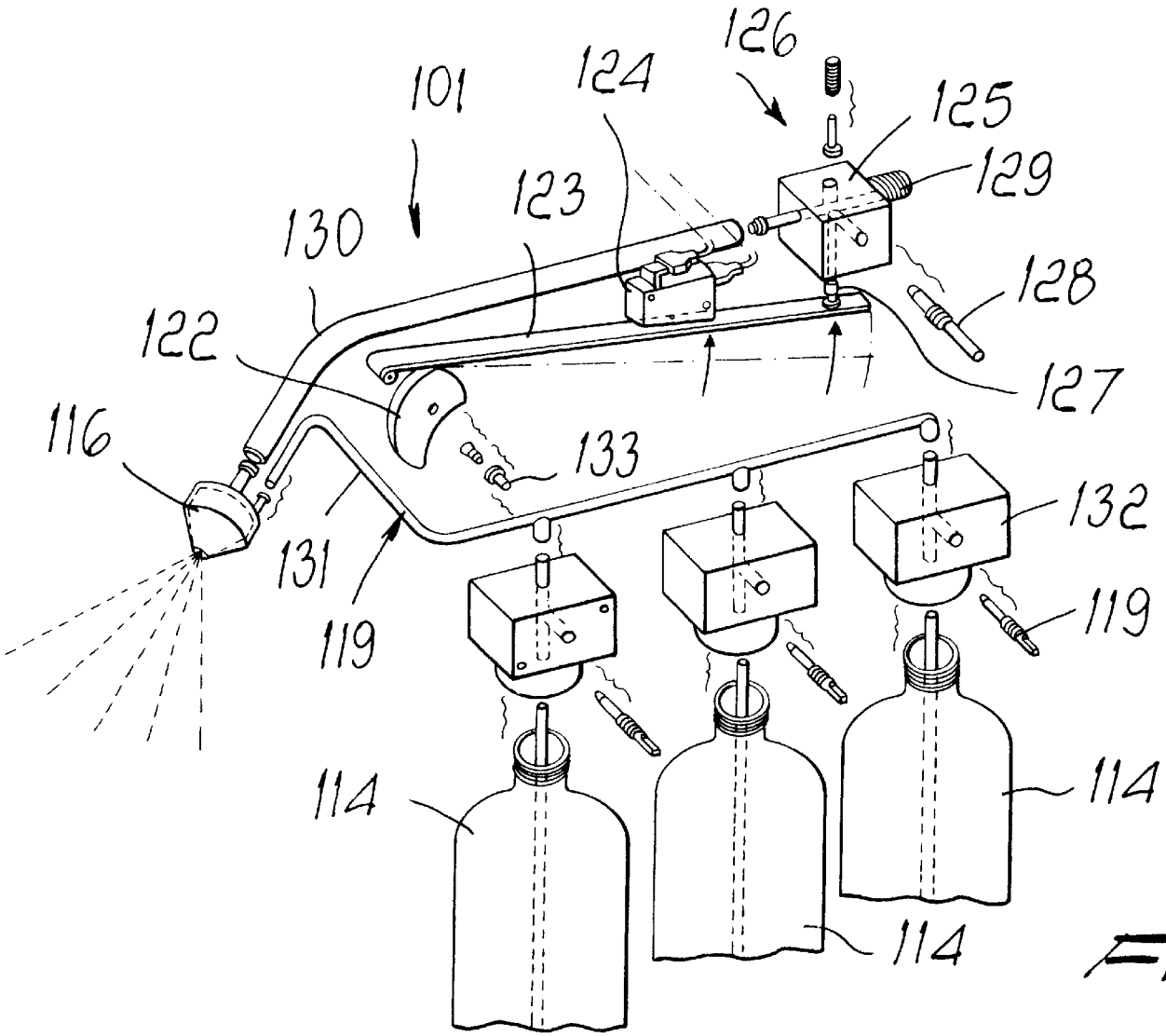
FIG. 8 is a view of another structural embodiment of the invention.
Figure 9:
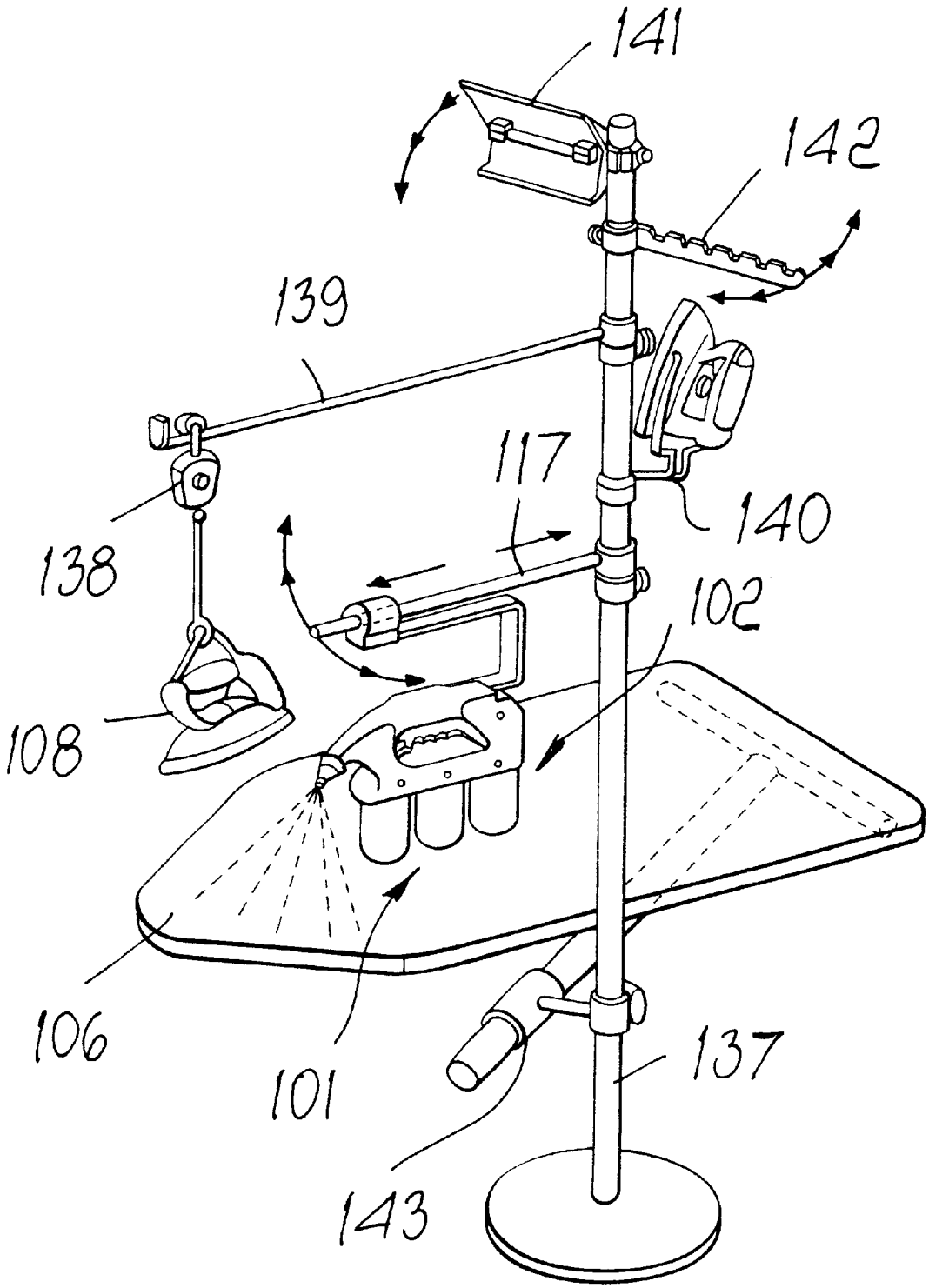
FIG. 9 is a view of another embodiment of a rotatable bracket with which the invention can be associated.
Figure 10:
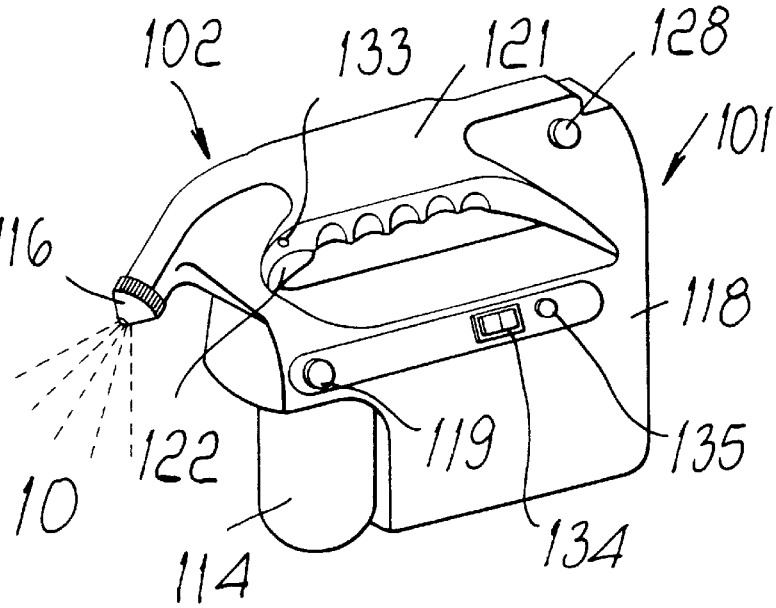
FIGS. 10 and 11 are views of the embodiment of FIG. 8.
Figure 11:
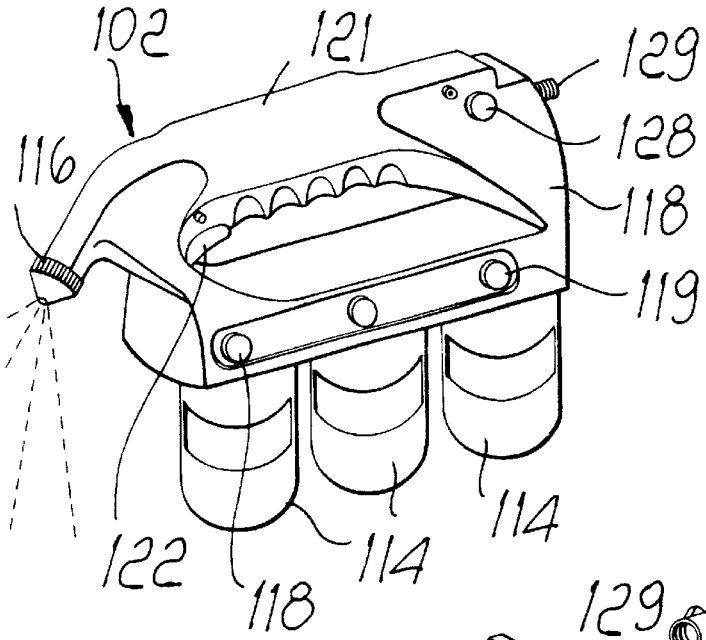
Figure 12:
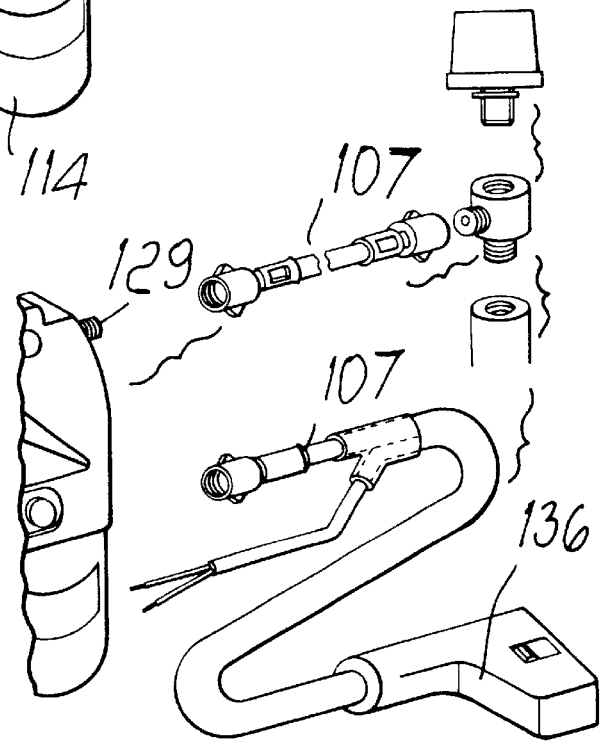
FIG. 12 is a schematic view of the mechanical or mechanical/electric connections to the invention.

With reference to the above cited figures, the reference numeral 1 designates a vapor distribution device, particularly usable on its own or together with electrical household appliances, such as for example an iron 2*a* (FIGS. 1, 2 and 4), a floor cleaning machine 2*b* (FIG. 4 again) or an ironing board 2*c* combined with a steam boiler (FIGS. 5 to 7).

The electrical household appliances 2*a*, 2*b* and 2*c* have a boiler, designated by the reference numeral 3, for producing water vapor or steam; the boiler can be provided with means 4 for moving over the floor, such as the one usually used for cleaning floors by means of a scrubbing brush, designated by the reference numeral 5 in FIG. 4, or can be combined, as mentioned, with an ironing board 6.

In any case, the boiler 3 is connected through a first duct 7 to a first means 8 for distributing said steam, which is constituted for example in FIGS. 1, 2, 4, 5 and 7 by said iron 2*a* itself.

In the electrical household appliances shown in FIGS. 1, 3, 4, 6 and 7, along said first duct 7 there is advantageously a shunt, designated by the reference numeral 9, for a second duct 10 for feeding steam to the vapor distribution device 1.

Figure 1:
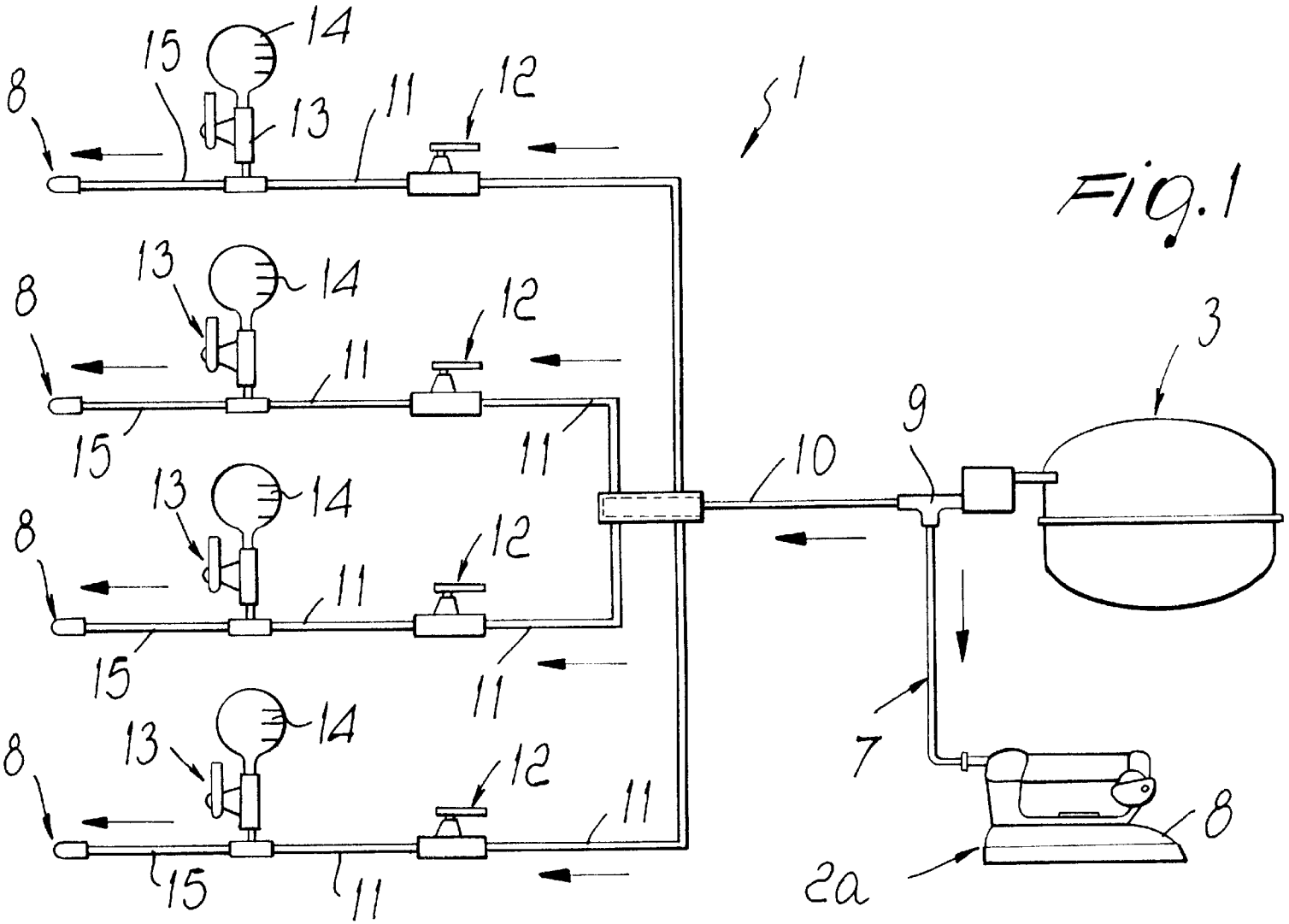
FIG. 1 is a schematic view of the invention.

The vapor distribution device 1, shown schematically in FIG. 1, is advantageously constituted by a plurality of third ducts, generally designated by the reference numeral 11, which are connected in parallel to each other to the second duct 10 and are preferably controlled by respective first safety valves 12.

Downstream of each first safety valve 12, along each one of the third ducts 11, there is at least one flow control means constituted by a second valve, designated by the reference numeral 13, for connection to a container 14 for a specific additive.

The additive, which is preferably present in liquid form, drips by gravity through the second valve 13, and is atomized and entrained downstream by the flow of steam along a fourth duct, designated by the reference numeral 15.

As an additive one can use, for example, a fragrance, a sizing agent, a cleaning or stain-removing or sterilizing product, depending on the particular use and on the effects that one wishes to obtain;

The fourth ducts 15 shown in FIGS. 1, 4, 6 and 7 lead to second distribution means 16, which is advantageously constituted by outlets that allow to adjust, orientate and apply the steam mixed with the additives to the selected region.

The vapor distribution device can be advantageously associated, as in FIGS. 6 and 7, with a rotatable bracket 17, so as to allow it to move to the most suitable position.

The device can also be optionally enclosed in a hollow box-like body, designated by the reference numeral 18, which is suitable to protect it against accidental impacts and dirt.

Figure 3:
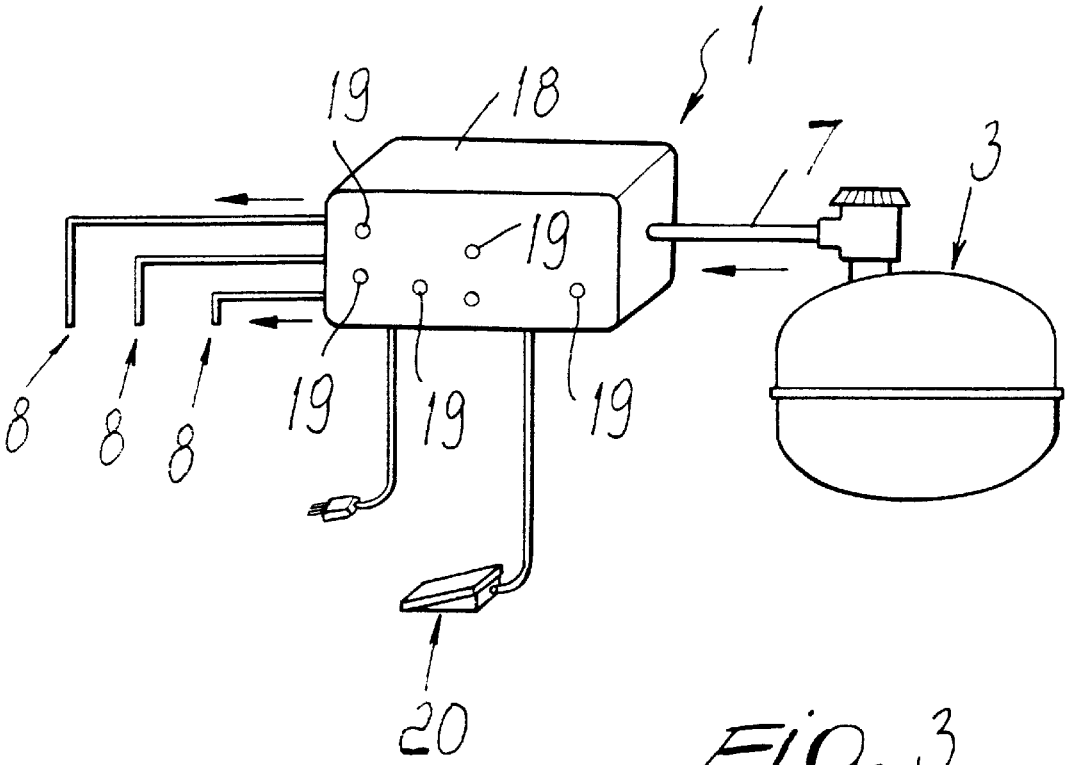

The hollow box-like body 18 has, on at least one face, one or more activation and/or adjustment means, generally designated by the reference numeral 19, for the first and second valves 12 and 13; it is optionally possible to also provide different activation and/or adjustment means, such as a pedal system, designated by the reference numeral 20 in FIG. 3.

The hollow box-like body 18 must furthermore be internally accessible, so that it is possible to change said containers 14.

Figure 2:
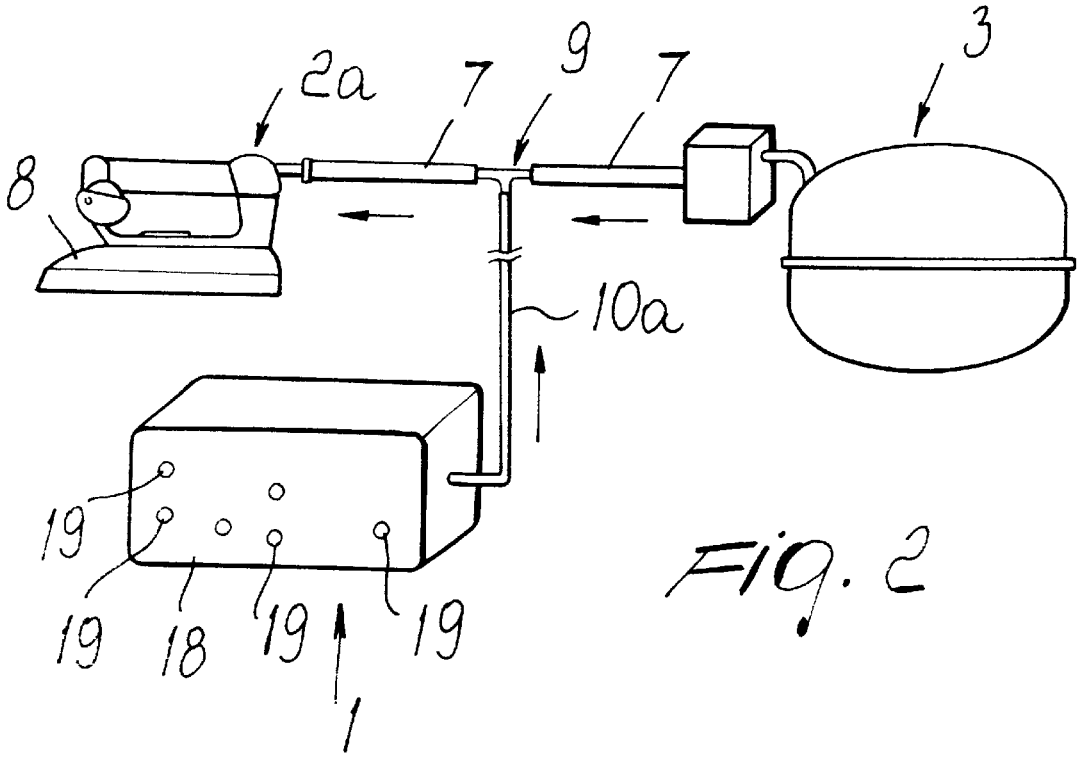
FIGS. 2 to 5 are side views of different embodiments of the invention.

FIGS. 2 and 5 illustrate a vapor distribution device 1 associated with an electrical household appliance constituted respectively by an iron 2*a* and by an ironing board 2*c* combined with a steam boiler 3.

A shunt, designated by the reference numeral 9*a*, is provided along the first duct 7 and is suitable to allow the additives, which come from the second duct 10*a* for connection to the device, to enter the first duct 7.

The operation of the invention is therefore as follows: with reference to FIGS. 1, 4, 6 and 7, separate electrical household appliances are illustrated which are provided with a first duct 7 for feeding at least one first steam distribution means 8 and the vapor distribution device 1, which is conveniently supplied with steam through the second duct 10.

By acting on the first and second valves 12 and 13 or on the adjustment and/or activation means 19, and optionally on a pedal system 20 or on activation means that is equivalent thereto, the user can activate the temporary outflow of one or more additives, such as for example fragrances, sizing agents and stain removers, from the respective containers 14.

The additives, which are mostly present in the liquid state, are atomized by the flow of steam and entrained with it toward one or more second distribution means 16, through which the steam, enriched with the additives, can be directed toward the medium to be treated.

In this manner, for example, it is possible to spray on the items of clothing being a stain remover, a sizing agent or starching agent, and a fragrance.

FIGS. 2 and 5 illustrate another embodiment, in which only the first distribution means 8 is provided, which is advantageously constituted by an iron.

Finally, FIG. 3 illustrates still another embodiment of the invention, which also comprises only said first distribution means 8, which is constituted in particular by a plurality of ports for applying the steam to the medium to be treated.

In both of these embodiments, the user, by acting on the adjustment and/or activation means 19, can use the additives contained in the distribution device 1, applying them to the items of clothing directly through the iron, in the first case, or by means of the outlets, in the second case.

As shown in FIGS. 8 to 12, the numeral 101 designates a device for distributing vapors that arrive from a boiler through a first duct 107, the device being incorporated in a gun 102.

The gun is composed of a hollow box-like body, designated by the reference numeral 118, which comprises a handle 121 that can be gripped by the user.

The hollow box-like body 118 has one or more activation and/or adjustment means, generally designated by the reference numeral 119, for solenoid-operated valve, which is not shown; such means are constituted by a button 122 that can be activated by the user and is pivoted transversely to the box-like body.

The button activates the rotation of a lever 123, which is pivoted at one end to the box-like body and interacts with a microcontrol 124 that is connected to a solenoid-operated valve for steam control.

At its free end, the lever 123 interacts, by means of an actuation pivot 127, with a valve body 125 for steam adjustment, which is provided with an overpressure valve 126, with a steam adjustment cock 128, and with a connector 129 for the first duct 107.

The duct is connected, by means of a steam tube 130 located inside the box-like body 121, to second means 116 for distributing the steam and additives, mixed thereat by the merging of a priming tube 131, located inside the box-like body and connected to one or more containers 114 for the additives by means of a duct formed in a valve body 132 below which the containers are detachably associable.

On the valve body 132 there is adjustment means 119, such as cocks for adjusting the priming of the liquids placed inside the containers.

It is also possible to use a device for locking the position of the button 122, constituted by a secondary button 133 that protrudes laterally to the handle 121.

It is furthermore possible to arrange, on the box-like body 118, a control switch 134 for a heating element that is present in the boiler and a lamp 135 that indicates depletion of the water present in the boiler.

The gun 102 can be fed by means of the first duct 107, connected to the pressurized boiler, and a separate electric power supply cable, or by means of a single element that combines the two and is therefore provided with a single known connector 136 for steam connection and electrical connection, controlled by the control of the steam delivery electric valve.

The vapor distribution device can be advantageously slidingly associated with a bracket 117 that is rotatably associated with a rod 137, so as to allow it to move to the most suitable position.

It is also possible to rotatably associate with the rod 137 other devices, such as a rod 139 on which a first support 138 for engaging an iron 108 slides, a second vertically adjustable support 140 for an iron, a lamp 141, a clothes hanger 142, and a third support 143 for the frame of an ironing board 106.

It has thus been found that the invention has achieved the intended aim and objects, a vapor distribution device particularly suitable for small electrical household appliances such as for example an iron having been devised which allows to convey the intended additives onto the target rapidly and simply, by utilizing the flow of pressurized steam.

The use of noxious propellant gases is thus avoided, while reducing at the same time the amount of waste products to be disposed of, since it is possible to market, for example, small refill containers or even large bottles suitable for topping up the respective containers.

The invention furthermore allows to make said additives act in depth, since the temperature and pressure of the steam that exits from the boiler are used as a means for better penetration of said additives.

Finally, the device allows to dispense onto the product to be ironed steam that arrives for example both from the iron and from the second distribution means 16, thus providing a large amount of steam per unit surface on the item to be ironed.

The invention is of course susceptible of numerous modifications and variations, all of which are within the scope of the same inventive concept.

The materials used, as well as the dimensions that constitute the individual components of the invention, may of course be more pertinent according to specific requirements.

The disclosures in Italian Patent Application No. TV2000A000155 from which this application claims priority are incorporated herein by reference.

What is claimed is:

1. A vapor distribution device, particularly for electrical household appliances provided with a boiler for producing water vapor or steam, which is connected through a first duct to at least one first means for distributing said steam, comprising at least one separate second duct for feeding the steam to at least one second distribution means, with the interposition of flow control means for one or more containers of separate additives.

2. The device according to claim 1, wherein said flow control means is constituted by one or more first safety valves suitable to allow the temporary flow of the steam from said second duct to said at least one second distribution means.

3. The device according to claim 2, wherein downstream of each one of said one or more first safety valves there is at least one flow control element, constituted by a second valve for connection to one of said one or more containers of additives.

4. The device according to claim 3, wherein said one or more first safety valves are arranged at one or more third ducts for connection between said second duct and said second valves.

5. The device according to claim 4, wherein said additive descends by gravity or by forcing through said second valve, and is atomized by the flow of the steam and entrained downstream by it along a fourth duct for connection to said at least one second distribution means.

6. The device according to claim 2, wherein said at least one second distribution means is constituted by an outlet that is suitable to allow the adjustment and/or orientation and application of the steam mixed with said additives on a preset medium.

7. The device according to claim 1, wherein said device is enclosed in a hollow box-like body that is suitable to protect the device from accidental impacts and dirt, said hollow box-like body having, on at least one face, one or more means for activating and/or adjusting said first and second valves.

8. The device according to claim 7, wherein said hollow box-like body is internally accessible in order to replace said containers once they are depleted.

9. A vapor distribution device particularly for electrical household appliances provided with a boiler for producing water vapor or steam connected through a duct to a means for distributing said steam, wherein said duct for feeding the steam to said distribution means is controlled by flow control means for one or more containers of separate additives.

10. The device according to claim 9, wherein said flow control means is constituted by one or more valves that allow the temporary flow of the steam from said supply duct to said one or more containers of additives.

11. The device according to claim 9, wherein said additive descends by gravity or forcing through one of said one or more valves and is atomized by the passage of the steam and entrained downstream by said steam toward said distribution means.

12. The device according to claim 9, wherein said steam distribution means is constituted by an outlet that allows adjustment and/or orientation and application of the steam mixed with said additives onto a preset medium.

13. The device according to claim 10, wherein said device is enclosed in a hollow box-like body that is suitable to protect said device from accidental impacts and dirt, said hollow box-like body having, on at least one face, one or more means for activating and/or adjusting said one or more valves.

14. The device according to claim 13, wherein said hollow box-like body is internally accessible in order to replace said containers once they are depleted.

15. The device according to claim 9, wherein said additive, which is present in the liquid state, is constituted by a fragrance.

16. The device according to claim 9, wherein said additive, which is present in the liquid state, is constituted by a sizing agent.

17. The device according to claim 9, wherein said additive, which is present in the liquid state, is constituted by a cleaning and/or stain-removing product.

18. The device according to claim 9, wherein said additive, which is present in the liquid state, is constituted by a sterilizing product.

19. The device according to claim 9, wherein a second steam supply duct allows the additional utilization of said steam on an item to be ironed.

20. The device according to claim 9, wherein said device is incorporated in a gun which is composed of a hollow box-like body that comprises a handle that can be gripped by the user, said hollow box-like body having one or more means for activating and/or adjusting an electric valve, said means being constituted by a button which can be activated by the user and is pivoted transversely to said box-like body.

21. The device according to claim 20, wherein said button activates the is rotation of a lever which is pivoted at one end to said box-like body and interacts with a microcontrol connected to an electric valve for steam control, said lever interacting, at its free end, by virtue of an actuation pin, with a steam adjustment valve body, provided with an overpressure valve, with a steam adjustment cock and with a connector for said duct.

22. The device according to claim 21, wherein said first duct is connected, through a steam tube arranged inside said box-like body, to second means for distributing the steam and the additives, mixed thereat by virtue of the merging of a priming tube, arranged inside said box-like body and connected to one or more containers of said additives by means of a duct formed in a valve body below which said containers are detachably associable.

23. The device according to claim 22, wherein on said valve body adjustment means is provided, such as cocks for adjusting the priming of the liquids placed inside said containers.

24. The device according to claim 20, further comprising a device for locking the position of said button which is constituted by a secondary button that protrudes laterally to said handle.

25. The device according to claim 20, wherein on said box-like body a control switch is arranged for a heating element that is present in the boiler and a lamp that indicates depletion of the water that is present in the boiler, said gun being supplied through said first duct, connected to the pressurized boiler, and a separate electrical power supply cable, or by virtue of a single element that combines the two.

26. The device according to claim 20, wherein said device is slidingly associated with a bracket that is rotatably associated with a rod, so as to allow to move the device to the most suitable position; a rod on which a first engagement support for an iron slides, being rotatably associated with said rod.

27. The device according to claim 20, wherein a second vertically adjustable support for an iron is rotatably associable with said rod.

28. The device according to claim 20, wherein a lamp is rotatably associated with said rod.

29. The device according to claim 20, wherein a clothes hanger is rotatably associated with said rod.

30. The device according to claim 20, wherein a third support for a frame of an ironing board is rotatably associated with said rod.

* * * * *